US010555868B2

(12) United States Patent
DiBenedetto

(10) Patent No.: US 10,555,868 B2
(45) Date of Patent: Feb. 11, 2020

(54) FOOT MASSAGING ASSEMBLY

(71) Applicant: Armando DiBenedetto, Fleming Island, FL (US)

(72) Inventor: Armando DiBenedetto, Fleming Island, FL (US)

( * ) Notice: Subject to any disclaimer, the term of this patent is extended or adjusted under 35 U.S.C. 154(b) by 807 days.

(21) Appl. No.: 15/185,778

(22) Filed: Jun. 17, 2016

(65) Prior Publication Data

US 2017/0360650 A1 Dec. 21, 2017

(51) Int. Cl.
*A61H 15/00* (2006.01)

(52) U.S. Cl.
CPC ..... *A61H 15/00* (2013.01); *A61H 2015/0014* (2013.01); *A61H 2015/0021* (2013.01); *A61H 2201/0119* (2013.01); *A61H 2201/0157* (2013.01); *A61H 2201/0192* (2013.01); *A61H 2201/164* (2013.01); *A61H 2201/1635* (2013.01); *A61H 2201/1685* (2013.01); *A61H 2201/1695* (2013.01); *A61H 2203/0425* (2013.01); *A61H 2205/12* (2013.01)

(58) Field of Classification Search
CPC ..... A61H 15/00; A61H 15/0092; A61H 2205/12; A61H 2015/0007; A61H 2015/005; A61H 2015/0035; A61H 2015/0014; A61H 2015/0021; A61H 2201/164; A61H 2201/192; A61H 2201/1635; A61H 1/0266; A61H 39/00; A61H 7/007; A63B 2022/185; A63B 21/4033; A63B 21/4034; A63B 21/4037; A63B 21/4041; A63B 21/4049; A63B 22/0046; A63B 22/16; A63B 22/18; A63B 23/00; A63B 23/035; A63B 23/04; A63B 23/0405; A63B 23/0494; A63B 23/08; A63B 23/085; A63B 23/10; A63B 25/00; A63B 25/02; A63B 25/04; A63B 25/08; A63B 26/00; A63B 26/003; F16B 2200/10; F16B 9/09

See application file for complete search history.

(56) References Cited

U.S. PATENT DOCUMENTS 4,142,809 A * 3/1979 Shell ..... F16B 12/34 403/201
D256,503 S 8/1980 Moustakas
4,989,585 A 2/1991 Auker
5,411,470 A 5/1995 Liptak et al.
5,700,232 A * 12/1997 Clausen ..... A63B 21/0552 482/125
5,766,210 A 6/1998 Komoroczy et al.
5,820,520 A * 10/1998 Sieber ..... A63B 23/0227 482/34
6,811,539 B1 11/2004 Nguyen
7,229,424 B2 6/2007 Jones et al.
7,559,881 B1 * 7/2009 Roraff ..... A63B 21/023 482/126

(Continued)

*Primary Examiner* — Tu A Vo

(57) ABSTRACT

A foot massaging assembly for massaging a user's feet includes a stand that may be positioned on a support surface. The stand may be vertically oriented on the support surface. A massage unit is slidably coupled to the stand. A bottom side corresponding to each of a user's feet may be rolled on the massage unit. Thus, the massage unit may massage the user's feet. The massage unit is selectively positioned at a selected point along the stand.

6 Claims, 4 Drawing Sheets

(56) References Cited

U.S. PATENT DOCUMENTS

| | | | | |
|---|---|---|---|---|
| 2003/0060332 | A1* | 3/2003 | Chen | A63B 25/00 482/23 |
| 2007/0197355 | A1* | 8/2007 | Brown | A63B 21/0085 482/111 |
| 2007/0232969 | A1* | 10/2007 | Yu | A61H 15/00 601/99 |
| 2010/0029449 | A1* | 2/2010 | Kim | A61H 7/001 482/121 |
| 2012/0028765 | A1* | 2/2012 | Morin | A61H 15/00 482/91 |
| 2013/0345609 | A1* | 12/2013 | Miller | A61H 15/00 601/120 |
| 2014/0066275 | A1* | 3/2014 | Miller, Jr. | A63B 21/068 482/142 |
| 2016/0058656 | A1* | 3/2016 | Harvel | A61H 15/0092 601/122 |
| 2016/0367427 | A1* | 12/2016 | Malone | A61H 1/024 |

* cited by examiner

FOOT MASSAGING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to massaging devices and more particularly pertains to a new massaging device for massaging a user's feet.

BRIEF SUMMARY OF THE INVENTION

An embodiment of the disclosure meets the needs presented above by generally comprising a stand that may be positioned on a support surface. The stand may be vertically oriented on the support surface. A massage unit is slidably coupled to the stand. A bottom side corresponding to each of a user's feet may be rolled on the massage unit. Thus, the massage unit may massage the user's feet. The massage unit is selectively positioned at a selected point along the stand.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
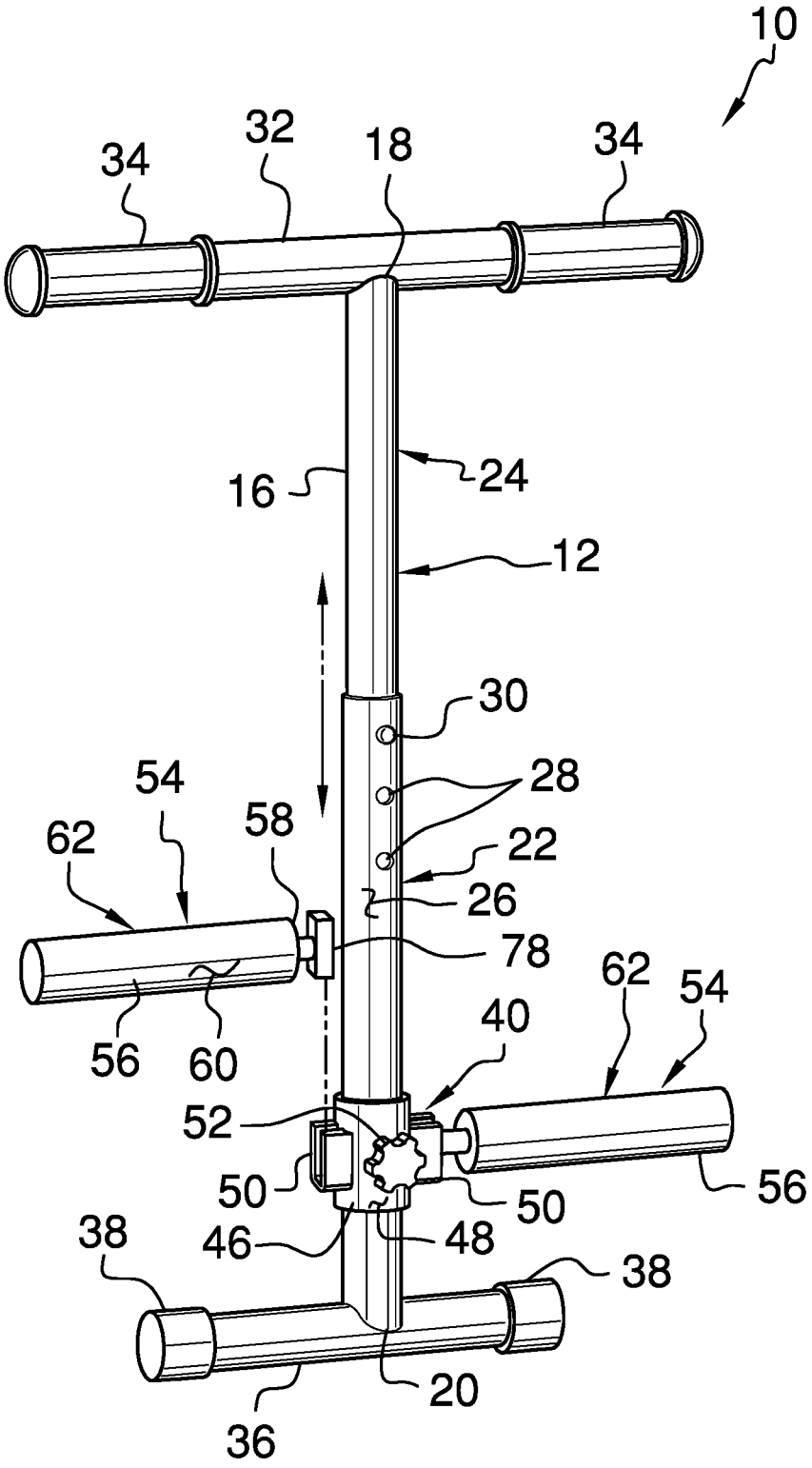
FIG. 1 is a perspective view of a foot massaging assembly according to an embodiment of the disclosure.
Figure 2:
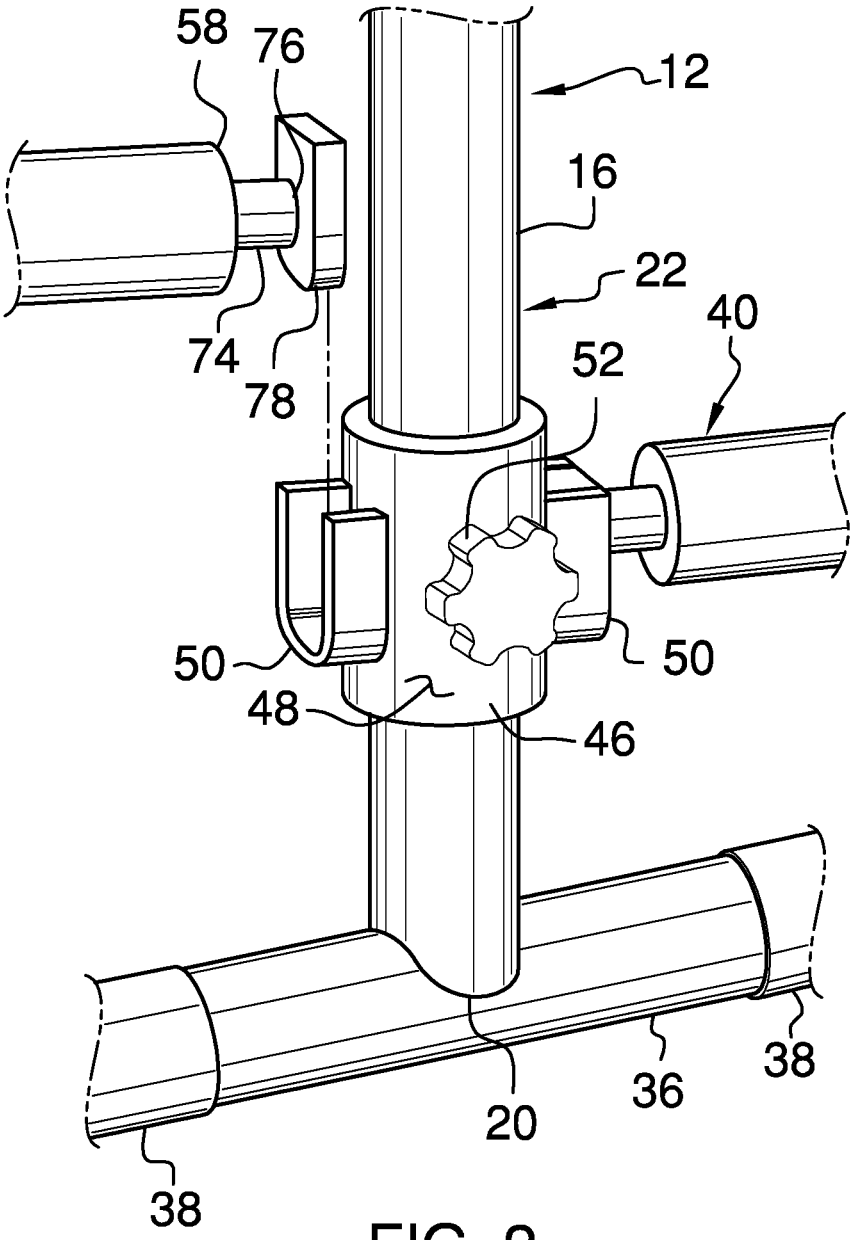
FIG. 2 is a front perspective view of an embodiment of the disclosure.
Figure 3:
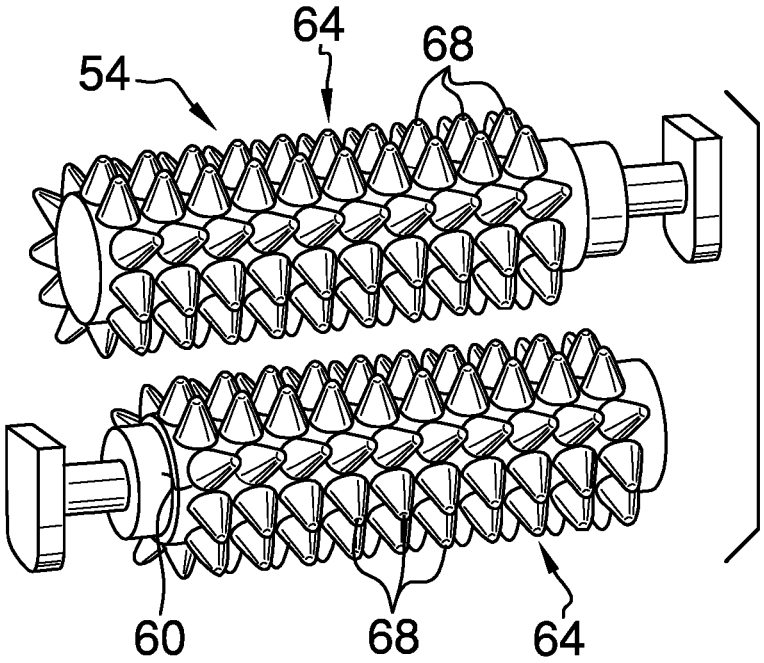
FIG. 3 is a perspective view of a second pair of rollers of an embodiment of the disclosure.
Figure 4:
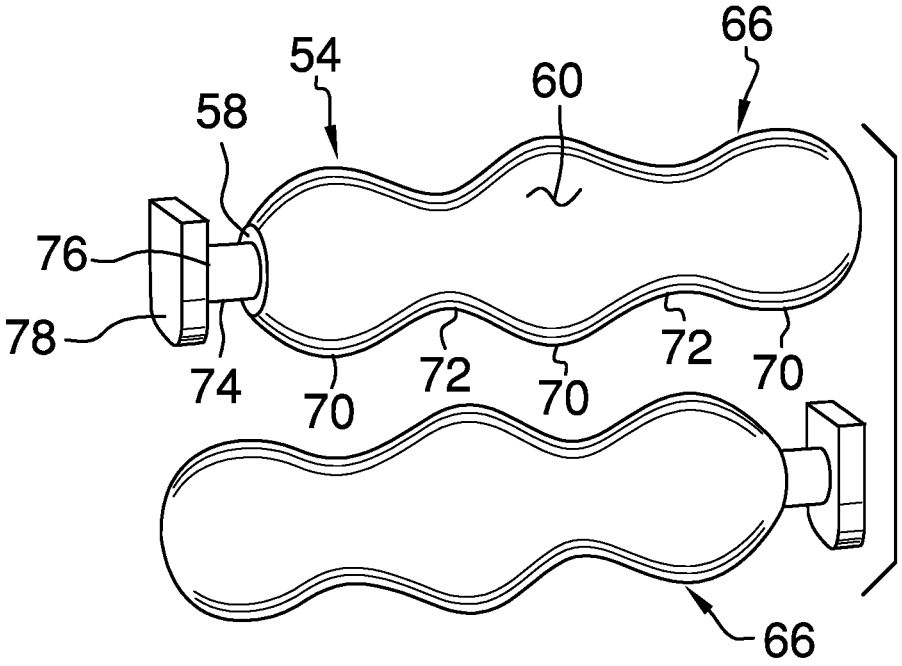
FIG. 4 is a perspective view of third pair of rollers of an embodiment of the disclosure.
Figure 5:
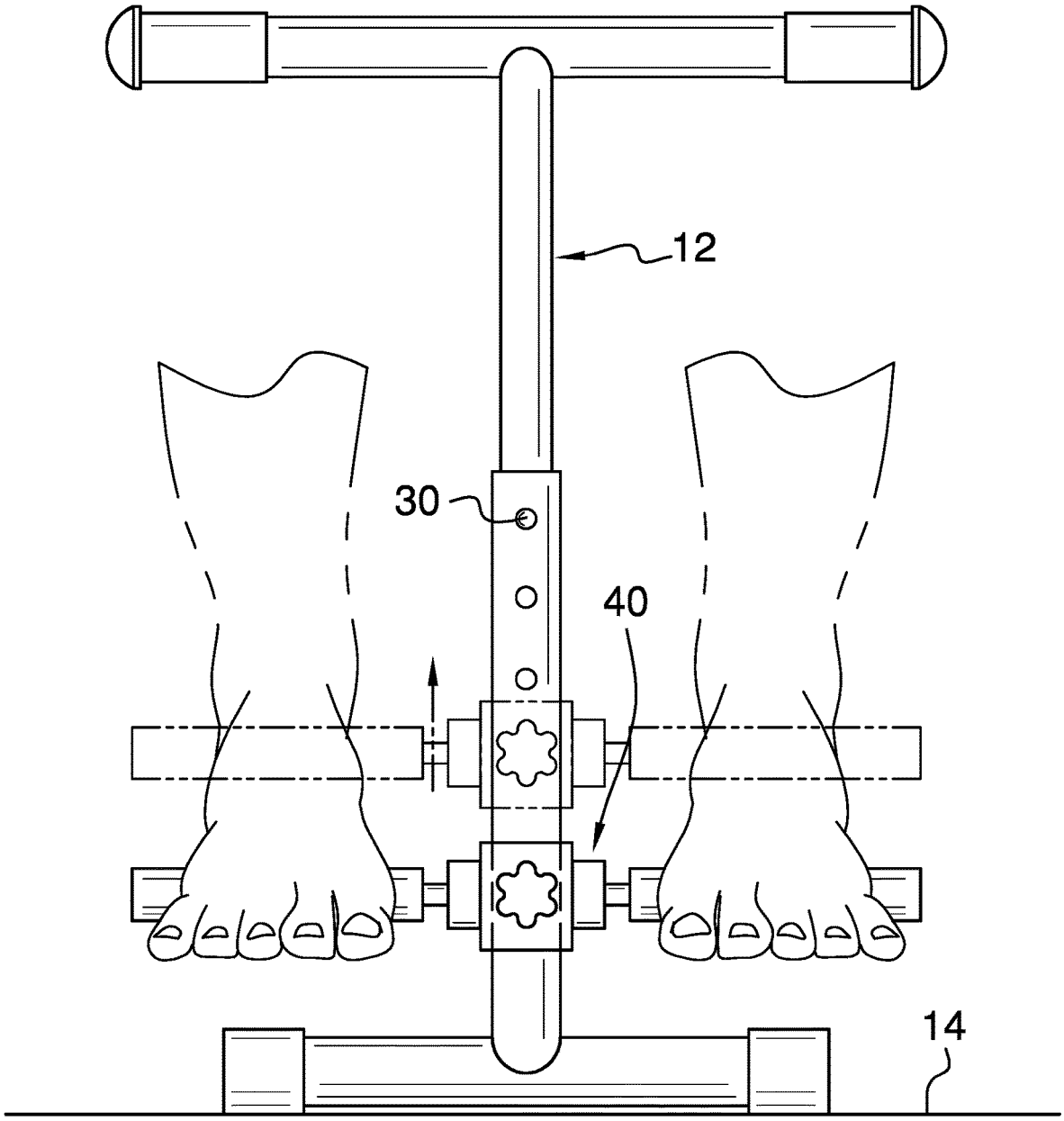
FIG. 5 is a perspective in-use view of an embodiment of the disclosure.

With reference now to the drawings, and in particular to FIGS. 1 through 5 thereof, a new massaging device embodying the principles and concepts of an embodiment of the disclosure and generally designated by the reference numeral 10 will be described.

As best illustrated in FIGS. 1 through 5, the foot massaging assembly 10 generally comprises a stand 12. The stand 12 may be positioned on a support surface 14 such that the stand 12 is vertically oriented on the support surface 14. The support surface 14 may comprise a floor or the like. The stand 12 comprises a first rod 16 that has a first end 18 and a second end 20. The first rod 16 has a first section 22 that is slidably coupled to a second section 24. Thus, the first rod 16 has a telescopically adjustable length.

The first section 22 has an outermost surface 26 and the outermost surface 26 has a plurality of apertures 28 extending therethrough. The apertures 28 are spaced apart from each other and are distributed along the first section 22. A ball 30 is movably coupled to the second section 24. The ball 30 engages a selected one of the apertures 28. Thus, the first rod 16 is retained at a selected height. The ball 30 is biased to extend outwardly from the second section 24 via a spring or the like.

A second rod 32 is coupled to the first end 18 of the first rod 16 and the second rod 32 is oriented perpendicular to the first rod 16. A pair of grips 34 is provided. Each of the grips 34 is coupled to the second rod 32 and each of the grips 34 may be manipulated. The grips 34 are spaced apart from each other on the second rod 32. Each of the grips 34 may be comprised of a resiliently compressible material thereby enhancing gripping the grips 34.

A third rod 36 is coupled to the second end 20 of the first rod 16. The third rod 36 is oriented perpendicular to the first rod 16. The third rod 36 may abut the support surface 14 thereby facilitating the second rod 32 to be spaced from the support surface 14. A pair of cups 38 may be provided and each of the cups 38 may be coupled to an associated one of opposite ends of the third rod 36. Each of the cups 38 may be comprised of a resiliently compressible material. Each of the cups 38 may frictionally engage the support surface 14. Thus, the stand 12 is inhibited from sliding on the support surface 14.

A massage unit 40 is slidably coupled to the stand 12. A bottom side 42 corresponding to each of a user's feet 44 may be rolled on the massage unit 40. Thus, the massage unit 40 may massage the user's feet 44. The massage unit 40 is selectively positioned at a selected point along the stand 12.

The massage unit 40 comprises a sleeve 46 that is slidably positioned around the first rod 16. Thus, the sleeve 46 is positioned at a selected point along the first rod 16. The sleeve 46 has an outer surface 48 and the sleeve 46 includes a pair of saddles 50. Each of the saddles 50 is coupled to the outer surface 48 of the sleeve 46. The saddles 50 are oppositionally positioned on the sleeve 46 with respect to each other.

A retainer 52 is rotatably coupled to the sleeve 46 and the retainer 52 may be manipulated. The retainer 52 extends through the sleeve 46 and selectively engages the first rod 16. Thus, the sleeve 46 is retained at the selected point on the first rod 16. The retainer 52 may comprise a knob coupled to a bolt or the like. The bolt may threadably engage the sleeve and the knob may be manipulated.

A plurality of rollers 54 is provided. Each of a selected pair 56 of the plurality of rollers 54 is removably positioned in an associated one of the saddles 50. Thus, the selected pair of rollers 56 may have the user's feet 44 rolled thereon. Each of the plurality of rollers 54 has a first end 58 and an exterior surface 60. The exterior surface 60 is textured to enhance massaging the user's feet 44.

The plurality of rollers 54 may include a first pair of rollers 62, a second pair of rollers 64 and a third pair of rollers 66. Each of the first 62, second 64 and third 66 pair of rollers may have a unique texture with respect to each other. The exterior surface 60 corresponding to the first pair of rollers 62 may be smooth. The exterior surface 60 corresponding to the second pair of rollers 64 may comprise a plurality of spiked protrusions 68. The exterior surface 60 corresponding to the third pair of rollers 66 may comprise an alternating sequence of hills 70 and valleys 72.

Each of the rollers 54 includes a shaft 74 that is rotatably coupled to the first end 58. The shaft 74 corresponding to each of the rollers 54 has a distal end 76 with respect to the first end 58 of the associated roller 54. A plate 78 is coupled to the distal end 76 of the shaft 74 and the plate 78 slidably engages the associated saddle 50. Thus, the corresponding roller 54 extends laterally away from the first rod 16. Each of the first rollers 62 and the second rollers 64 rotates about an axis extending through the first end 58 of the roller 54 and the plate 78. Each of the third pair of rollers 66 is fixedly coupled to the shaft 74.

In use, the ball 30 is manipulated to retain the first rod 16 at the selected length. Each of the selected pair of rollers 56 is positioned in the associated saddle 50. The sleeve 46 is positioned at the selected point on the first rod 16. Thus, each of the selected pair of rollers 56 is retained at a selected height with respect to the support surface 14. Each of the grips 34 is gripped and of the user's feet is rolled on the associated roller 54. The user's feet are rolled on each of the first rollers 62 and the second rollers 64. The user's feet are pressed against a selected point on the third rollers 66. Thus, the third rollers 66 exert pressure on a selected point on the user's feet.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A foot massaging assembly being configured to have a user's feet rolled thereon thereby facilitating said assembly to massage the user's feet, said assembly comprising:

a stand being configured to be positioned on a support surface such that said stand is vertically oriented on the support surface, said stand including a first rod; and a massage unit being slidably coupled to said stand wherein said massage unit is configured to massage a bottom side of each of a user's feet rolled on said massage unit thereby facilitating said massage unit to massage the user's feet, said massage unit being selectively positioned at a selected point along said stand, said massage unit comprising a sleeve being slidably positioned around said first rod such that said sleeve is positioned at a selected point along said first rod, said sleeve having an outer surface, said sleeve including a pair of saddles, each of said saddles being directly coupled to said outer surface of said sleeve, said saddles being oppositionally positioned on said sleeve with respect to each other, each of said saddles having two upper ends forming an open upper end, and a retainer being rotatably coupled to said sleeve wherein said retainer is configured to be manipulated, said retainer extending through said sleeve and selectively engaging said first rod such that said sleeve is retained at said selected point on said first rod; said stand comprises said first rod having a first end and a second end, said first rod having a first section being slidably coupled to a second section such that said first rod has a telescopically adjustable length; a second rod being coupled to said first end, said second rod being oriented perpendicular to said first rod; and a third rod being coupled to said second end, said third rod being oriented perpendicular to said first rod wherein said third rod is configured to abut the support surface thereby facilitating said second rod to be spaced from the support surface; and a plurality of rollers, each of a selected pair of said plurality of rollers being removably positioned in an associated one of said saddles wherein said selected pair of rollers is configured to have the user's feet rolled thereon.

2. The assembly according to claim 1, further comprising a pair of grips, each of said grips being coupled to said second rod wherein each of said grips is configured to be manipulated, said grips being spaced apart from each other.

3. The assembly according to claim 1, wherein each of said plurality of rollers has a first end and an exterior surface, said exterior surface being textured wherein said exterior surface is configured to enhance massaging the user's feet, each of said selected pair of rollers having a unique texture with respect to each selected pair of rollers.

4. The assembly according to claim 3, wherein each of said rollers includes a shaft being coupled to said first end, said shaft corresponding to each of said rollers having a distal end with respect to said first end of said roller.

5. The assembly according to claim 4, further comprising a plate being coupled to said distal end of said shaft, said plate slidably engaging said associated saddle such that corresponding roller extends laterally away from said first rod.

6. A foot massaging assembly being configured to have a user's feet rolled thereon thereby facilitating said assembly to massage the user's feet, said assembly comprising:

a stand being configured to be positioned on a support surface such that said stand is vertically oriented on the support surface, said stand comprising:

a first rod having a first end and a second end, said first rod having a first section being slidably coupled to a second section such that said first rod has a telescopically adjustable length, a second rod being coupled to said first end, said second rod being oriented perpendicular to said first rod, a pair of grips, each of said grips being coupled to said second rod wherein each of said grips is configured to be manipulated, said grips being spaced apart from each other, a third rod being coupled to said second end, said third rod being oriented perpendicular to said first rod wherein said third rod is configured to abut the support surface thereby facilitating said second rod to be spaced from the support surface; and a massage unit being slidably coupled to said stand wherein said massage unit is configured to massage a bottom side of each of a user's feet rolled on said massage unit thereby facilitating said massage unit to massage the user's feet, said massage unit being selectively positioned at a selected point along said stand, said massage unit comprising:

sleeve being slidably positioned around said first rod such that said sleeve is positioned at a selected point along said first rod, said sleeve having an outer surface, said sleeve including a pair of saddles, each of said saddles being directly coupled to said outer surface of said sleeve, said saddles being oppositionally positioned on said sleeve with respect to each other, each of said saddles having two upper ends forming an open upper end, a retainer being rotatably coupled to said sleeve wherein said retainer is configured to be manipulated, said retainer extending through said sleeve and selectively engaging said first rod such that said sleeve is retained at said selected point on said first rod, a plurality of rollers, each of a selected pair of said plurality of rollers being removably positioned in an associated one of said saddles wherein said selected pair of rollers is configured to have the user's feet rolled thereon, each of said plurality of rollers having a first end and an exterior surface, said exterior surface being textured wherein said exterior surface is configured to enhance massaging the user's feet, each of said selected pair of rollers having a unique texture with respect to each selected pair of rollers, each of said rollers including:

a shaft being coupled to said first end, said shaft corresponding to each of said rollers having a distal end with respect to said first end of said roller, and a plate being coupled to said distal end of said shaft, said plate slidably engaging said associated saddle such that corresponding roller extends laterally away from said first rod.

* * * * *